United States Patent [19]

Kunkel

[11] Patent Number: 4,815,592

[45] Date of Patent: Mar. 28, 1989

[54] NESTED CIGARETTE PACKAGE SPACER

[75] Inventor: Larry Kunkel, Louisville, Ky.

[73] Assignee: Brown & Williamson Tobacco Corporation, Louisville, Ky.

[21] Appl. No.: 49,773

[22] Filed: May 13, 1987

[51] Int. Cl.[4] ..... A24F 15/00

[52] U.S. Cl. ..... 206/264; 206/256; 206/242; 206/804; 206/814; 206/815; 229/DIG. 9

[58] Field of Search ..... 206/264, 242, 379, 427, 206/432, 256, 257, 259, 258, 271, 274, 275, 443, 593, 804, 814, 813, 815; 229/DIG. 9, 120.3 L

[56] References Cited

U.S. PATENT DOCUMENTS

| | | | |
|---|---|---|---|
| 547,938 | 10/1895 | Pusey | 229/DIG. 9 |
| 945,121 | 1/1910 | Flynn | 206/427 |
| 1,323,442 | 12/1919 | Bemis | 206/259 |
| 1,433,560 | 10/1922 | Lund | 206/815 |
| 1,728,608 | 9/1929 | Hamilton | 206/275 |
| 1,916,119 | 6/1933 | Schwartz et al. | 206/815 |
| 2,109,601 | 3/1938 | Walter | 229/DIG. 9 |
| 2,159,355 | 5/1939 | Goetze | 229/DIG. 9 |
| 2,563,132 | 8/1951 | Paige | 206/814 |
| 2,755,983 | 7/1956 | Ringler | 229/DIG. 9 |
| 2,762,550 | 9/1956 | Goettsch et al. | 229/DIG. 9 |
| 2,795,365 | 6/1957 | Currie | 229/DIG. 9 |
| 2,818,970 | 1/1958 | Pough | 206/249 |
| 2,820,545 | 1/1958 | Bramhill | 206/264 |
| 2,910,175 | 10/1959 | Williams | 206/259 |
| 2,947,460 | 8/1960 | Baumann | 229/DIG. 9 |
| 2,962,202 | 11/1960 | Hansen | 229/DIG. 9 |
| 2,995,256 | 8/1961 | Schoenfisch | 206/379 |
| 3,206,020 | 9/1965 | Billingsley et al. | 206/432 |
| 3,332,602 | 7/1967 | Flax | 229/DIG. 9 |
| 3,721,335 | 3/1973 | Grant | 206/256 |

FOREIGN PATENT DOCUMENTS

| | | | |
|---|---|---|---|
| 319649 | 3/1920 | Fed. Rep. of Germany | 206/249 |
| 520070 | 4/1940 | United Kingdom | 206/259 |

*Primary Examiner*—David T. Fidei

*Attorney, Agent, or Firm*—Charles G. Lamb

[57] ABSTRACT

Disclosed herein are package inserts for cigarette products which comprise mutually nestable package inserts having cut-out edges to facilitate the removal of tobacco products from a package and which interconnect with other packaging inserts having the same shape so as to permit the formation of multiple package inserts from a single piece of regularly shaped stock. The package inserts may be placed in cigarette packs or boxes or in cigarette cartons.

1 Claim, 7 Drawing Sheets

NESTED CIGARETTE PACKAGE SPACER

BACKGROUND OF INVENTION

1. Field of Invention

This invention relates to cigarette package spacers. More particularly this invention relates to package spacers used to promote tightly fitted packing of ultrathin cigarettes in thin cigarette packs and the packing of thin cigarette packs in standard width cartons.

2. Prior Art

For many years standard cigarette packs have had a relatively standard thickness and a height dependant upon whether the cigarette was of regular size, king size or ultra king size. Since the thickness of cigarette packs was standard, the thickness of cigarettes cartons necessarily did not vary. As a result, it was possible to manufacture cartons of a single width which would accommodate all cigarette packs.

In order to place the tax stamp which is required on the bottom of each cigarette pack, the usual procedure is to place the cigarette packs in the cigarette carton leaving the bottom end of the carton open which permits application of the cigarette tax stamp. Because in the past virtually all cigarette packs have been of the same width, except for highly specialized and costly brands, it was possible to use a single stamping machine to stamp cigarette cartons for all brands.

In recent years, the cigarette industry has sought to diversify its packing styles and cigarette types in order to maintain or increase market share. Among the packing changes which have been considered include the use of thinner and supposedly more attractive cigarettes. When 20 of these ultrathin cigarettes are packed in a standard cigarette pack, a large amount of the unoccupied space remains. Accordingly, cigarette manufacturers have redesigned cigarette packs and boxes to somewhat reduce their thicknesses. In addition, however, it has been necessary to provide internal packing material within each cigarette pack in order to take up additional space not occupied by the ultrathin cigarettes. Concomitantly, the use of thinner cigarette packs has required changes in the design of cigarette cartons. With thinner cigarette packs, there were two possibilities: either the carton could be made more narrow or a packing material could be inserted within each carton to allow the use of the same size of carton with the thinner cigarette pack.

The approach most preferred in the cigarette industry has been the use of added packing material to permit the use of a standard width carton. This procedure allows the use of previously purchased stamping machines without the need for costly modification of these machines; or the more costly alternative of having nonstandard packs hand stamped at the distributor level.

Several designs for carton and cigarette pack inserts have been attempted. However, each of the inserts used to date have been expensive to manufacture because of the large amount of packing material which is wasted during fabrication.

Thus, it is an object of this invention to prepare cigarette pack and cigarette carton packing materials.

It is a further object of this invention to prepare packing materials employing a process which reduces the amount of packing stock which is wasted during fabrication and/or permits the fabrication of a greater amount of packing materials from the same volume of stock.

It is yet another object of this invention to prepare packing materials which may be utilized with ultrathin cigarettes to permit the packing of these cigarettes into sightly thinner boxes and packages and to permit the use of these boxes and packages in standard sized cigarette cartons.

These and other objectives are obtained by preparing the packing materials according to the instant invention.

Summary of Invention

Basically, the packing materials of the instant invention are of a mutually nestable design which permit the stamping or cutting of the packing stock from a single sheet of cardboard or other packing material without the excess loss of stock material. The design of the cigarette pack insert is in the form of a modified "H" wherein the legs of the "H" may be nested into the top and bottom of the "H" such that numerous "H" designs may be obtained out of a single square of cardboard having a central "H" and two "H" legs from another "H" seeded in each top and bottom of the central "H". The carton packing material contains an indented section along the top and bottom for each cigarette pack to be placed in a cigarette carton. For example, S-shaped or square shaped indentations are designed to seat within complimentary S-shaped indentations so as to allow row upon row of seated indentations to produce complimentary packing materials out of a single sheet of packing material without any excess loss of stock material.

DETAILED DESCRIPTION OF INVENTION

The carton space and the pack spacer of the instant invention share the common element that they are nestable, one within the other, to provide efficient manufacturing of the spacers from a single sheet of stock material. Thus, the carton spacers may be formed from modified "S" or saw-tooth shaped sides wherein each saw-tooth or "S" nests one within another saw-tooth or "S" side. Similarly, the H-shaped cigarette pack spacer of the instant invention nests with surrounding H's within a central "H" to permit the manufacture of numerous H's from a single sheet of packing material without excess loss of packing stock.

Figure 1:
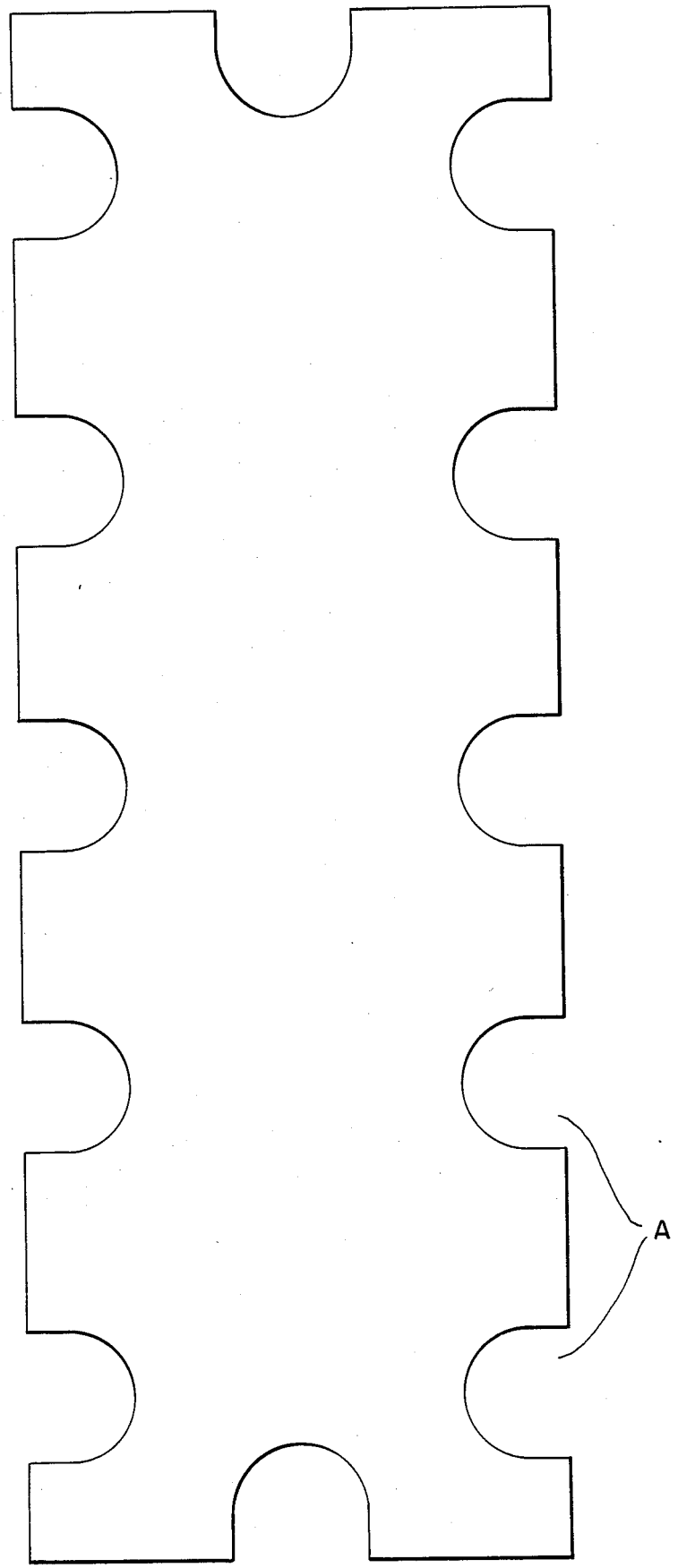
FIG. 1 PRIOR ART
FIG. 1 shows a top view of a prior art carton spacer.

The advantage of the nested carton or cigarette pack spacer described herein is that it permits the economical manufacture of spacer without attendant and significant waste of the spacing stock material. The prior art spacer as shown in FIG. 1 does not provide the nesting design described above. As a result, when this design is employed a significant percent of the spacing stock is lost during manufacture. When a typical cigarette company may sell millions of cartons of cigarettes in a single year, the magnitude of the loss represented by this wasted spacing material is significant.

Stated another way, the carton spacers and the pack spacers of the instant invention may be manufactured more economically from stock material because the nesting design of the instant invention permits a greater number of spacer to be manufactured from the same unit volume of stock material.

The spacing material utilized in the instant invention may be formed from any conventional packing material including cardboard, corrugated cardboard, styrofoam, vacuum formed plastic, corrugated plastic and any other type of material which can be readily manufactured in sheet form.

In FIG. 1 a typical, prior art, carton spacer is shown. This spacer is inserted inside of a cigarette carton to allow the use of standard sized cartons with less than standard width cigarette boxes or packs. Use of this spacer in turn permits the use of the standard tax stamping machines. The deficiency in this prior art package spacer, however, is that when the spacer as shown in FIG. 1 is formed, a large amount of stock in the indentation (A) is wasted each time a spacer is cut out.

Figure 2:
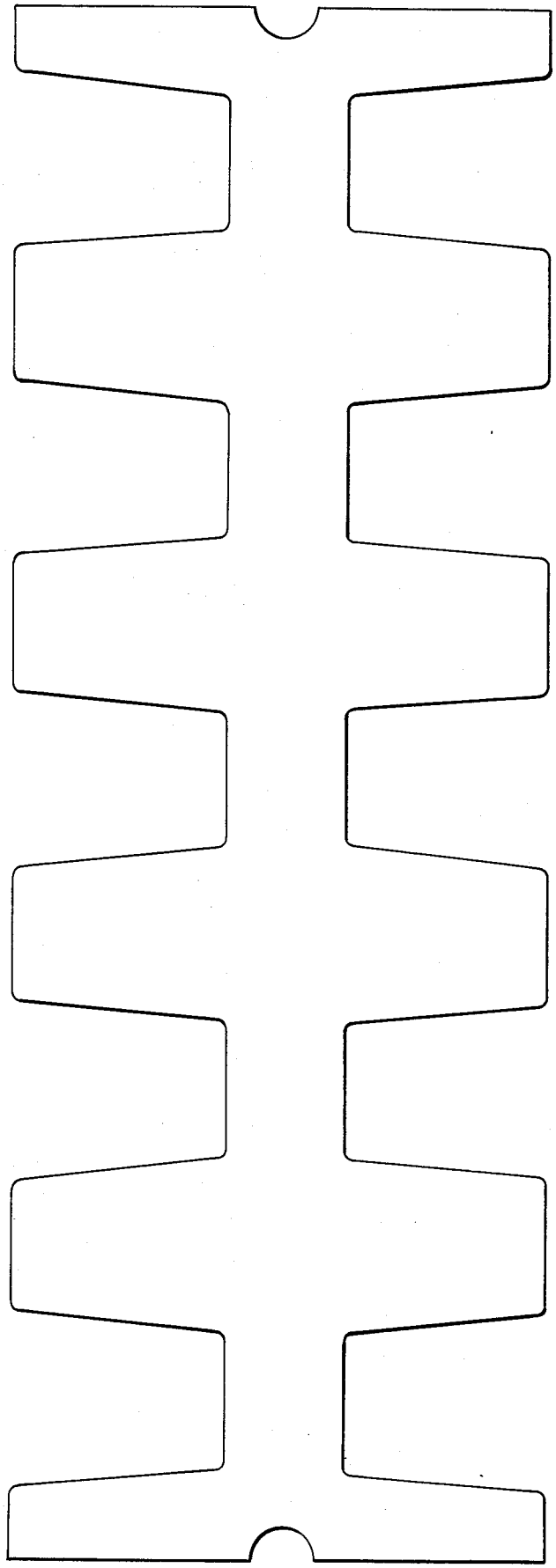
FIG. 2 shows a top view of a square, saw-tooth shaped carton spacer according to the instant invention.
Figure 3:
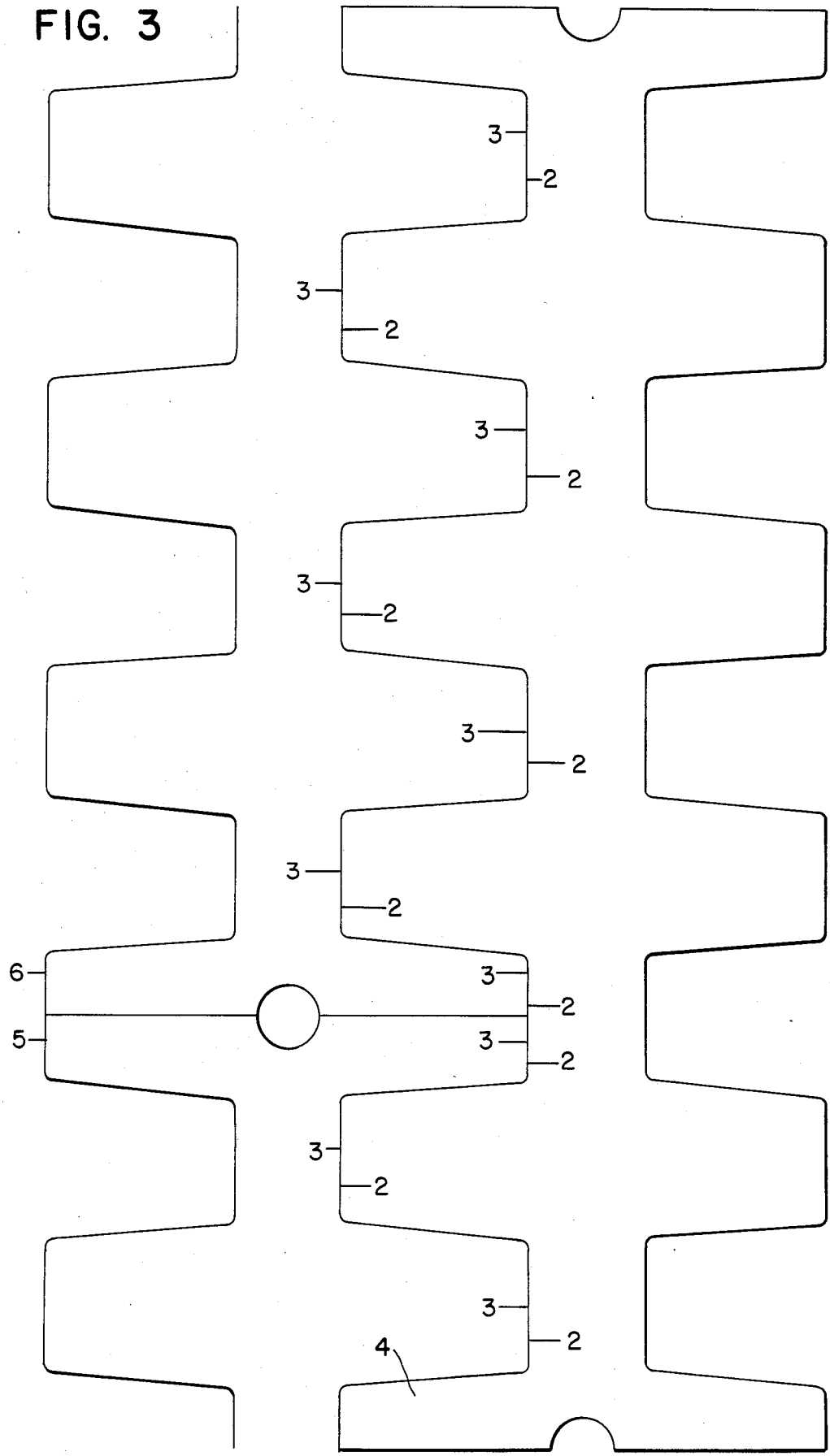
FIG. 3 shows a top view of a sheet of stock material which has been laid out to permit the manufacture of several complimentary, nesting carton spacers of the FIG. 2 type from the same sheet.

FIG. 2 shows the improved carton spacer obtained by the use of the instant invention. The approximately square, saw-toothed, indented carton spacer shown in FIG. 2 when cut from a single sheet of package stock, greatly reduces the amount of stock which is lost. As can be seen, particularly in FIG. 3, when the package stock is laid out with the spacers of FIG. 2, there is no significant loss of package stock due to cutting. Rather, the approximately square, saw-toothed edge (2) shown in FIG. 3 of one package spacer nests within a complementary saw-toothed edge (3) of another package spacer, thereby permitting the formation of several interconnected and nestable spacers (4), (5) and (6) from a single sheet of stock.

Figure 4:
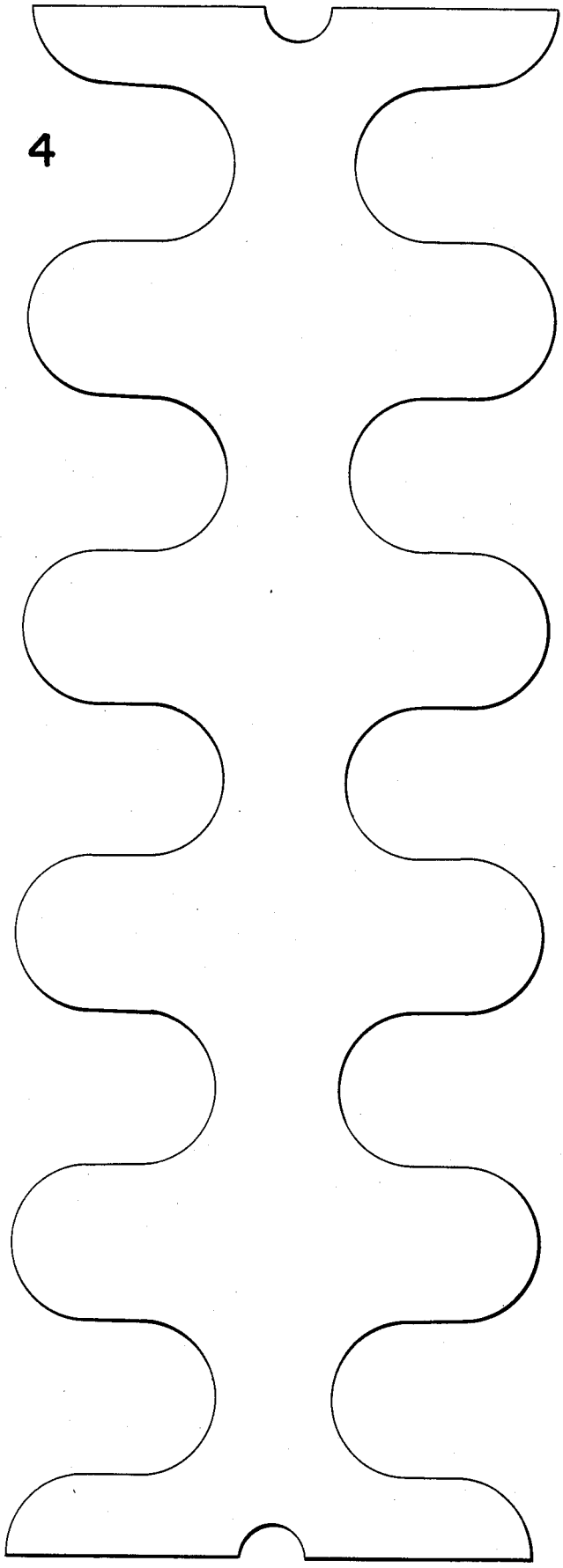
FIG. 4 shows a top view of an S-shaped spacer for cartons as described in the instant invention.
Figure 5:
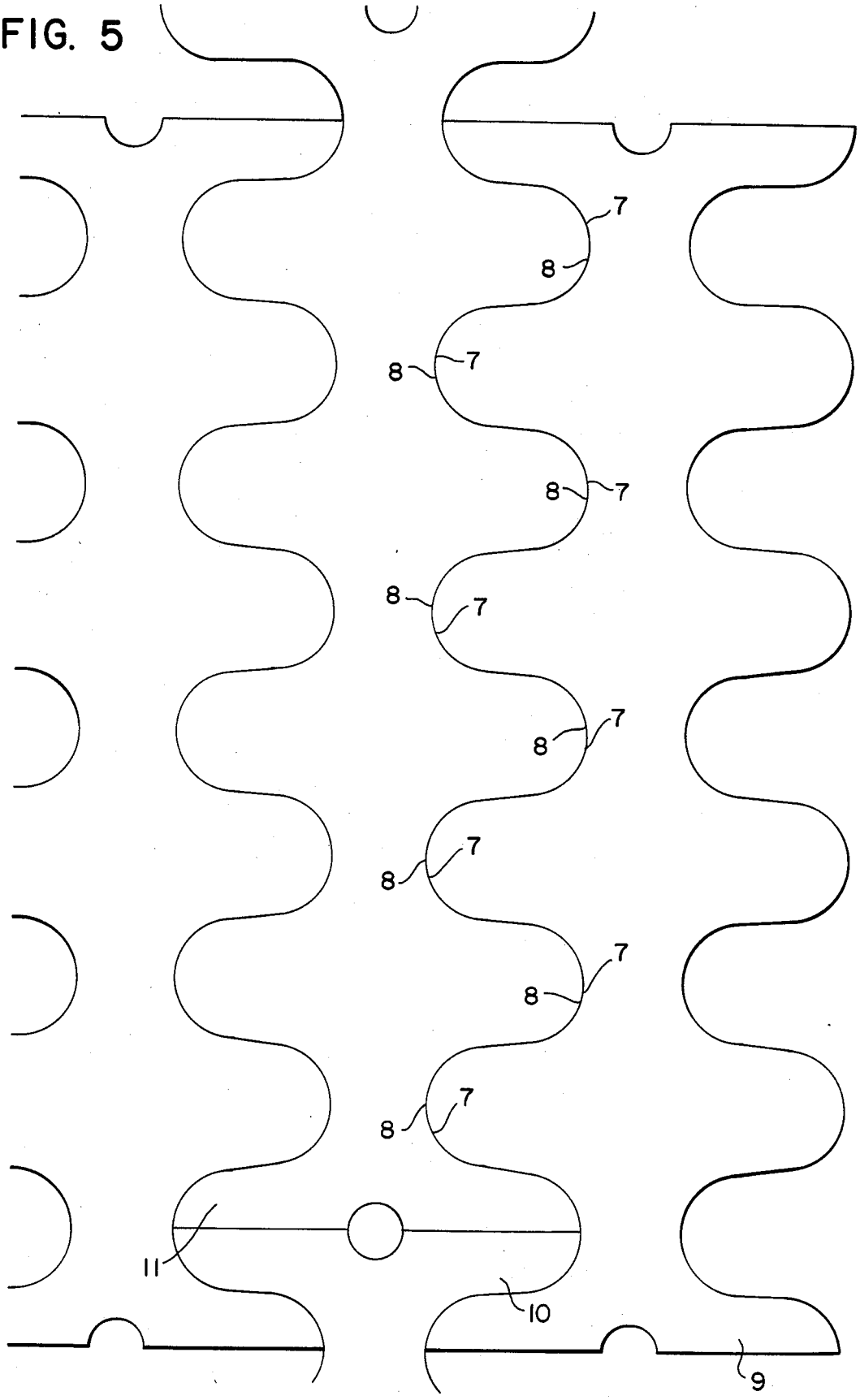
FIG. 5 shows a top view of the FIG. 4 design of spacer laid out on a single sheet of stock material.

Likewise, with respect to the "S" shaped carton spacer of FIG. 4, it is readily seen that this spacer can be laid out on a sheet of stock material as in FIG. 5 without any significant loss of stock due to cutting. Again, in FIG. 5, the "S" edge (7) of one spacer of FIG. 4 nests complementarily into a corresponding edge (8) of another nesting spacer, thereby permitting the formation of several interconnected and nestable spacers (9), (10) and (11) from a single sheet of stock.

Figure 6:
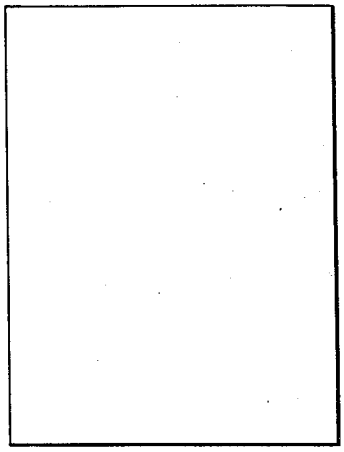
FIG. 6 shows a top view of a prior art cigarette pack spacer.
Figure 7:
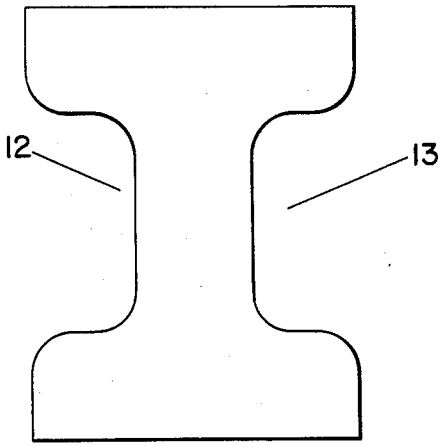
FIG. 7 shows a top view of one design of the H-shaped cigarette pack spacer of the instant invention.
Figure 8:
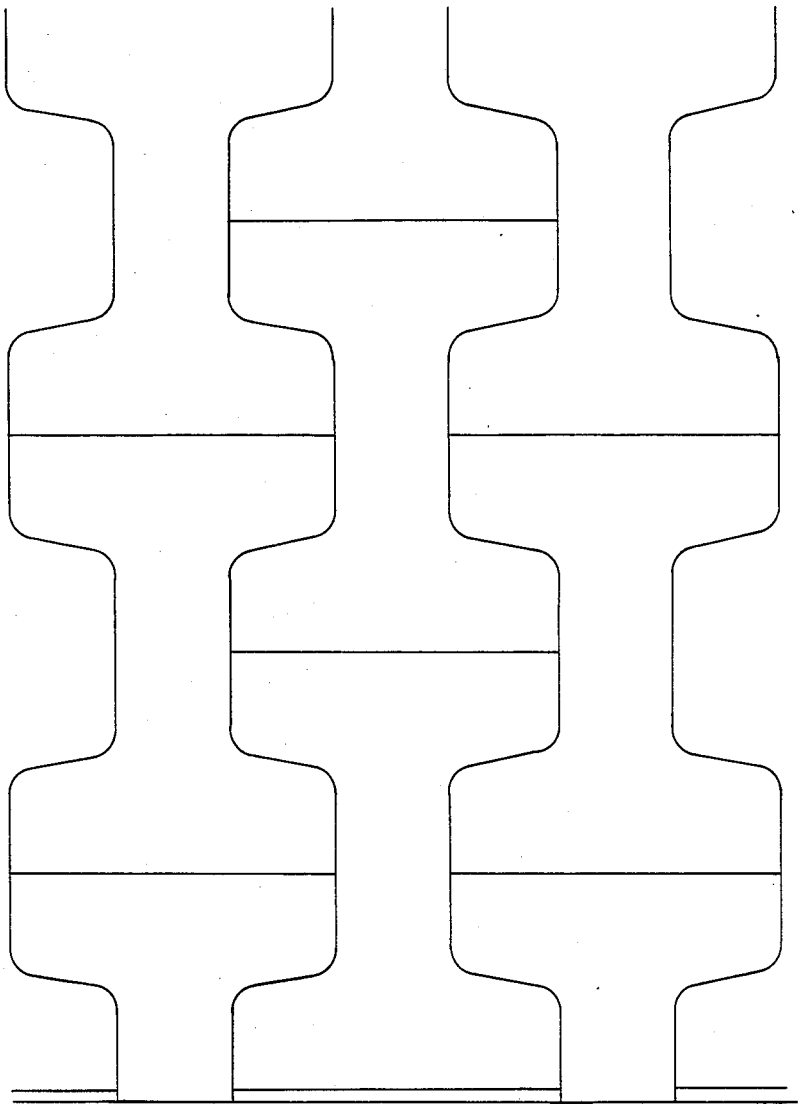
FIG. 8 shows a top view of the FIG. 7 pack space design laid out on a single sheet of stock according to the instant invention.

In addition to being useful in forming spacers for cigarette cartons, the concept of the instant invention readily lends itself to construction of spacers for use with individual cigarette packs. In FIG. 6 a prior art cigarette pack spacer is shown. As can be seen, the spacer requires the use of a large amount of spacer stock as compared to H-shaped spacer shown in FIG. 7. The H-shaped spacer of FIG. 7 may have fitted into its side arm areas (12) and (13) the arms from other H-shaped spacers which are cut-out from a single piece of packaging stock. As shown in FIG. 8, employing the H-shaped packing material permits the forming of many "H" shaped spacers from a sheet of stock without any significant loss of the stock material due to cutting.

It is essential when designing carton inserts for use according to the instant invention that each insert contain an indentation along each longest edge of the carton insert which indents near the middle of each pack of cigarettes. This indentation permits grasping of the cigarette carton and easy removal. Thus, for example, with ten pack, two row carton, there must be five indentations arranged regularly along each long side of the spacer.

Likewise, with cigarette pack inserts, the spacer should have an indentations so as to form an "X", "H" or "+" shaped spacer go as to provide for nesting of the inserts one within the other.

What is claimed is:

1. A rectangular spacer for use in a cigarette carton to be inserted between adjacent rows of cigarette packages contained in the carton comprising:

a plurality of uniformly spaced apart indentations formed along each longitudinal edge of the spacer, each of the indentations formed along one longitudinal edge being in alignment with a different one of the indentations formed along the other longitudinal edge transversely across the spacer, the centerline distance between adjacent indentations being substantially equal to the width of a cigarette package such that each indentation along each longitudinal edge will be substantially centered on a different one of the cigarette packages in a row of cigarette packages when inserted within the carton, each indentation having a nominal width measured across the opening into the indentations substantially equal to one half the width of a cigarette package, and the material between and defined by adjacent indentations being equal in size and shape to the indentations and the material between and defined by adjacent indentations being the compliment of the indentations in peripheral configuration whereby when a plurality of spacers are laid out on the package stock from which they are to be cut, the configuration of the longitudinal edges of each spacer are in completely nested relationship with the configuration of the longitudinal edge of the adjacent spacer.

* * * * *